United States Patent [19]

Doori

[11] 4,355,461

[45] Oct. 26, 1982

[54] APPARATUS FOR HOLDING SLIDERS ON AN ANGULARLY MOVABLE INDEXING MEANS

[75] Inventor: Hisashi Doori, Kurobe, Japan

[73] Assignee: Yoshida Kogyo K.K., Japan

[21] Appl. No.: 184,028

[22] Filed: Sep. 4, 1980

[30] Foreign Application Priority Data

Sep. 7, 1979 [JP] Japan ..... 54-115388

[51] Int. Cl.[3] ..... B23P 19/04

[52] U.S. Cl. ..... 29/768

[58] Field of Search ..... 29/33.2, 408, 409, 766, 29/768, 792, 794

[56] References Cited

U.S. PATENT DOCUMENTS

| | | | |
|---|---|---|---|
| 2,879,588 | 3/1959 | Morin | 29/768 X |
| 3,530,563 | 9/1970 | Maeda | 29/768 X |
| 3,792,521 | 2/1974 | Kawakami | 29/768 X |
| 4,236,304 | 12/1980 | Morita | 29/768 |

FOREIGN PATENT DOCUMENTS

| | | |
|---|---|---|
| 1010948 | 6/1957 | Fed. Rep. of Germany . |
| 1253228 | 11/1967 | Fed. Rep. of Germany . |
| 2365187 | 11/1975 | Fed. Rep. of Germany . |

*Primary Examiner*—Ervin M. Combs

*Attorney, Agent, or Firm*—Robert E. Burns; Emmanuel J. Lobato; Bruce L. Adams

[57] ABSTRACT

An apparatus for holding sliders for application to slide fastener stringers comprises an indexing plate for intermittently advancing sliders through consecutive angularly spaced positions, a chute, guide groove, and pusher rod for supplying a slider to the indexing plate at a first position, a presser member coacting with the indexing plate to lock the slider at a succeeding second position, and a pivotable lever for removing the slider from the indexing plate at a succeeding third position. The indexing plate includes a plurality of angularly spaced slider supports each for receiving one slider at a time and intermittently drivable by a rack-and-pinion mechanism powered by a fluid-pressure actuator.

12 Claims, 9 Drawing Figures

APPARATUS FOR HOLDING SLIDERS ON AN ANGULARLY MOVABLE INDEXING MEANS

BACKGROUND OF THE INVENTION

1. Field of the Invention

The present invention relates to an apparatus for holding sliders for application to pairs of slide fastener stringers.

2. Prior Art

Slide fasteners are finished normally by first sewing them to garments such as trousers or skirts, threading the slide fastener chains through sliders, and then attaching end stops to the slide fastener chains. There have been known various slider holders that are manually or automatically actuatable for holding sliders while slide fastener chains are being threaded therethrough. U.S. Pat. No. 3,874,057, patented Apr. 1, 1975, discloses an automatic slider holder which is vertically movable from a lower position in which a slider is received toward an upper position in which a slide fastener chain is manually threaded through the supported slider. The slider is then automatically released while the holder is being lowered. Accordingly, the operator has to let application of sliders wait until after each cycle of operation of the slider holder during which the sliders are discharged, supplied, and supported. Slider attachment on the prior slider holder is thus time-consuming, inefficient, and less productive.

SUMMARY OF THE INVENTION

An indexing plate having a plurality of slider supports angularly spaced from each other is rotatably mounted on a frame and drivable by a rack-and-pinion mechanism powered by a fluid-pressure actuator. A slider is supplied from a slider supply means to one of the slider supports at a time while the indexing plate is at rest. Then, the indexing plate is angularly moved to bring the slider to an angularly spaced position in which a slider locking means coacts with the slider support to lock the slider, through which a pair of slide fastener stringers either alone or attached to a garment is threaded. The indexing plate is again angularly moved to advance the slider toward another angularly spaced position in which the slider applied to the slide fastener stringers is removed from the slider support by a slider removing means which coacts with the rack-and-pinion mechanism. The indexing plate is intermittently rotated to let the slider supports which carry sliders arrive at the slider applying position one after another whereby the operator can thread slide fastener stringers through sliders without substantial loss of time.

It is an object of the present invention to provide an apparatus for holding sliders for application to pairs of slide fastener stringers at an increased rate.

Another object of the present invention is to provide a slider holding apparatus having relatively simple means for advancing sliders in sequence through angularly spaced positions in which the sliders are to be supplied, locked, and discharged.

Still another object of the present invention is to provide a slider applicator having a relatively wide space in which the operator can thread slide fastener stringers through a locked slider with utmost ease.

Still another object of the present invention is to provide a slider holding apparatus having means for advancing sliders rapidly toward and from a position in which they are to be locked for application to slide fastener stringers.

Many other advantages, features and additional objects of the present invention will become manifest to those versed in the art upon making reference to the detailed description and the accompanying drawings in which a preferred structural embodiment incorporating the principals of the present invention is shown by way of illustrative example.

DETAILED DESCRIPTION

Figure 1:
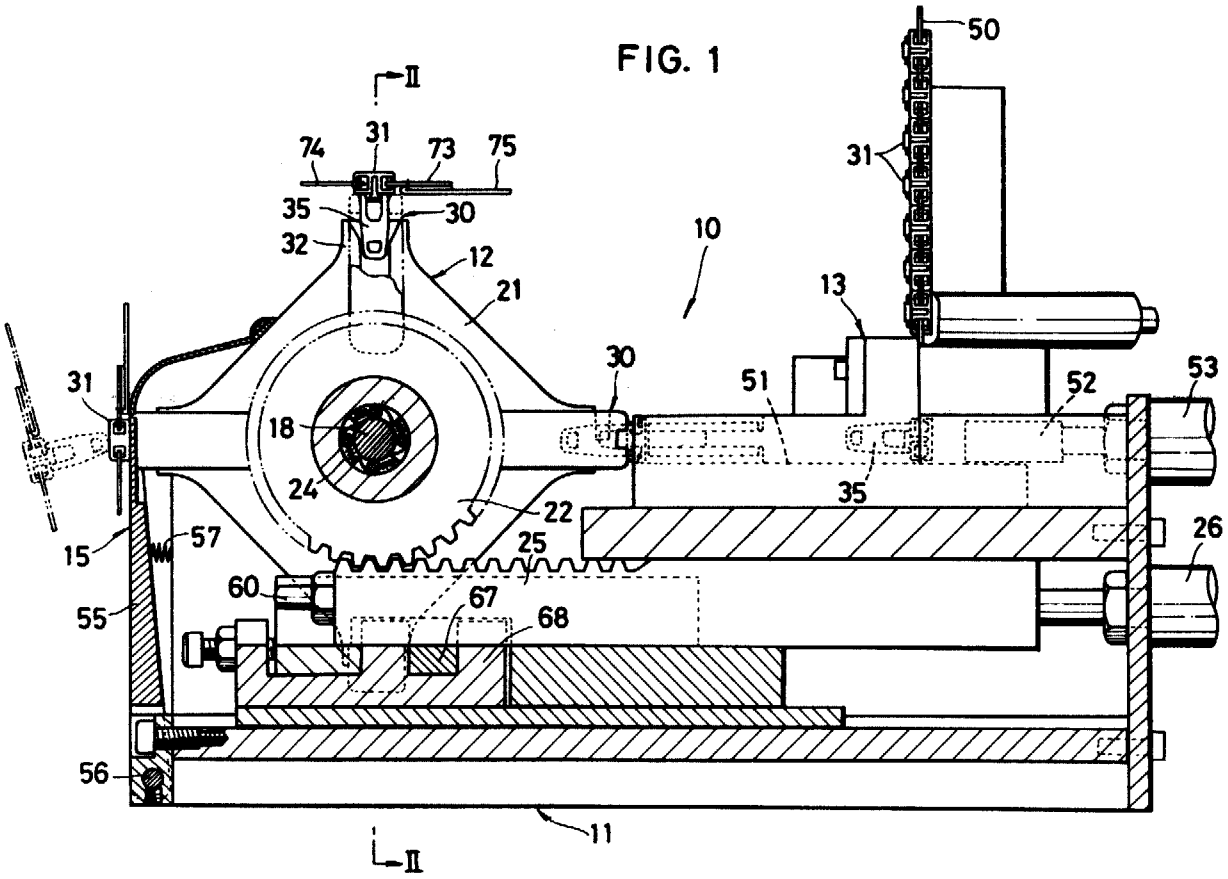
FIG. 1 is a front elevational view, partly in cross section, of an apparatus for holding sliders for application to pairs of slide fastener stringers.
Figure 2:
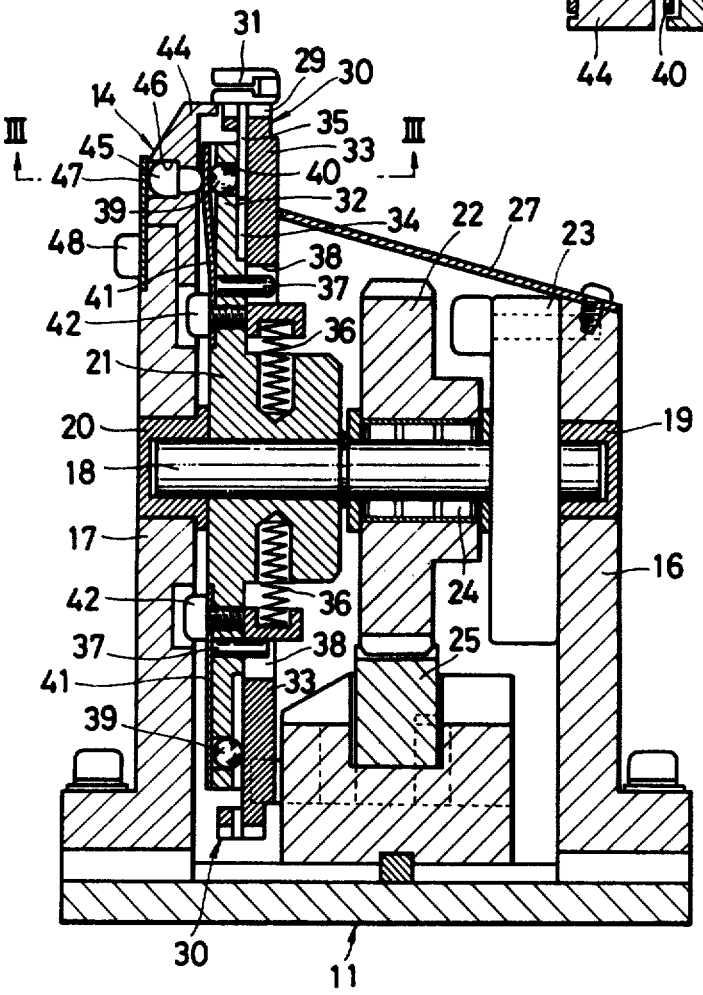
FIG. 2 is a vertical cross-sectional view taken along line II—II of FIG. 1.

The present invention is particularly useful when embodied in a slider holding apparatus or a slider applicator such as shown in FIGS. 1 and 2, generally indicated by the reference numeral 10.

The apparatus 10 generally comprises a frame 11, a slider advancing means 12, a slider supplying means 13, a slider locking means 14 (FIG. 2), and a slider removing means 15, all of the means being mounted on the frame 11. As best shown in FIG. 2, the frame 11 includes a pair of laterally spaced upstanding walls 16,17 between which is supported a horizontal shaft 18 rotatably journalled in a pair of bearings 19,20 mounted in the walls 16,17, respectively.

Figure 5:
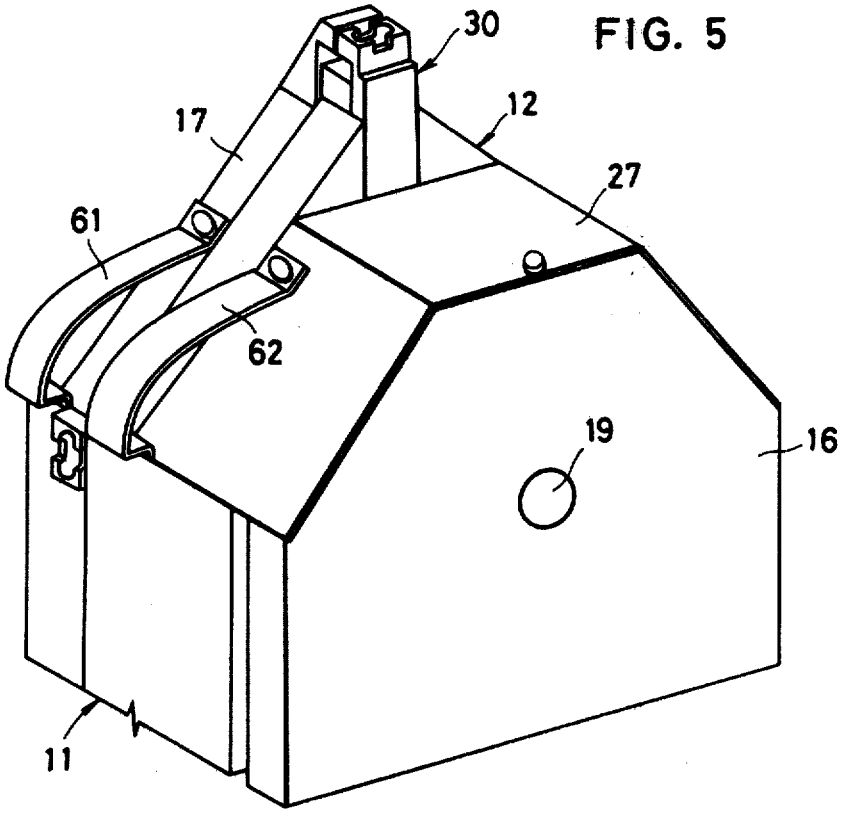
FIG. 5 is a perspective view of a portion of the apparatus of FIG. 1.

The slider advancing means 12 comprises a substantially square-shaped vertical indexing plate 21 corotatively mounted on the shaft 18. A pinion 22 and a brake 23 are also mounted on the shaft 18 in tandem relation to the indexing plate 21 between the walls 16,17. The brake 23 gives rotation of the shaft 18 a predetermined degree of resistance at all times. A one-way clutch 24 is interposed and coupled between the pinion 22 and the shaft 18 to allow the indexing plate 21 to be angularly moved in response to angular movement of the pinion 22 only in one direction (counterclockwise direction in FIG. 1). A rack 25 is slidably supported in the frame 11 in driving mesh with the pinion 22 and is reciprocably drivable a predetermined distance in the longitudinal directions by a fluid-pressure actuator 26 mounted on the frame 11 and operatively connected with the rack 25. The components of the apparatus 10 are housed in the frame 11 and covered by a cover plate 27 (FIGS. 2 and 5).

The indexing plate 21 has on its corners a plurality (four in the illustrated embodiment) of slider supports 30 angularly spaced from each other, each for carrying thereon one slider 31 at a time. Each of the slider supports 30 includes an arm 32 projecting radially outwardly from the indexing plate 21, and an elongate slide 33 slidably fitted in the arm 32 (FIG. 3) for radial movement along the arm 32. Between the arm 32 and the slide 33, there is defined a radial slot 34 that is receptive of a slider pull tab 35 when the slider 31 is seated on a slider rest 29 of the slide 33, as best illustrated in FIG. 2. The slide 33 is normally urged radially outwardly by a compression spring 36 acting between the slide 33 and the indexing plate 21. To limit radial movement of the slide 33, a pin 37 secured to the indexing plate 21 extends horizontally into a slot 38 in the slide 33.

A ball 39 is received in part in a hole 40 in the arm 32, which opens into the slot 34. The ball 39 is normally urged toward the slot 34 by a leaf spring 41 held in contact therewith and mounted on the indexing plate 21 by a screw 42. The ball 39 thus spring-biased partly enters a hole 43 (FIG. 3) in the slider pull tab 35 when the latter is inserted in the slot 34, and hence acts as a detent for retaining the slider 31 on the slider rest 29.

Figure 3:
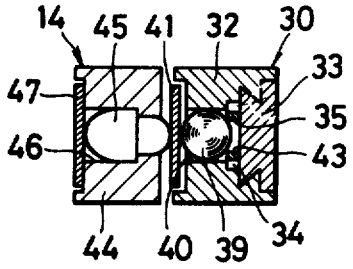
FIG. 3 is an enlarged horizontal cross-sectional view, taken along line III—III of FIG. 2, of a slider support and a slider locker coacting therewith.

As illustrated in FIGS. 2 and 3, the slider locking means 14 comprises a presser 45 disposed in an aperture 46 in a block 44 mounted on the wall 17. The block 44 is positioned in lateral alignment with one of slider supports 30 which has been brought into an uppermost position where a slider 31 supported thereon is to be applied to slide fastener stringers. A leaf spring 47 is fixed by a screw 48 to the wall 17 to normally urge the presser 45 into pressing engagement with the leaf spring 41 of such slider support 30. Accordingly, the slider 31 which has been retained on the slider support 30 by the spring-biased ball 39, is locked securely in position by the spring-biased presser 45 coacting with the ball 39 upon alignment of the slider support 30 with the slider locking means 14.

The slider supplying means 13 shown in FIG. 1 includes a chute 50 along which sliders 31 are fed by gravity downwardly into a horizontal guide groove 51, in which one slider 31 at a time is advanced, with the pull tab 35 directed forwardly, by a pusher rod 52 of a fluid-pressure actuator 53 mounted on the frame 11 toward one of the slider supports 30 which is horizontally alighed with the guide groove 51.

Figure 7:
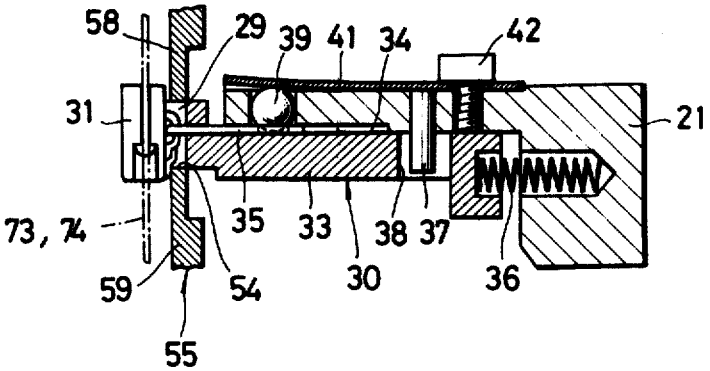
FIG. 7 is an enlarged cross-sectional view of a slider remover for discharging a slider from the slider support.

The slider removing means 15 includes a substantially vertical lever 55 (FIGS. 1 and 7) pivotably mounted on the frame 11 by a pin 56 and normally urged by a spring 57 toward the frame 11. The lever 55 has a pair of spaced fingers 58,59 (FIG. 7) defining therebetween a recess 54 which is receptive of the slider rest 29 of one of the slider supports 30 which is disposed diametrically opposite to the slider support 30 aligned with the guide groove 51 of the slider supplying means 13. The rack 25 supports thereon a rod 60 which, upon advancing movement of the rack 25 leftwardly in FIG. 1, pushes the lever 55 against the resiliency of the spring 57 to cause the fingers 58,59 to dismount the slider 31 off the slider rest 29, as described later on.

A pair of guards 61,62 (FIG. 5) is fixed to the wall 17 and the cover 27, respectively, for protecting slide fastener stringers threaded through sliders against getting caught by the indexing plate 21 into the apparatus 10.

Figure 4:
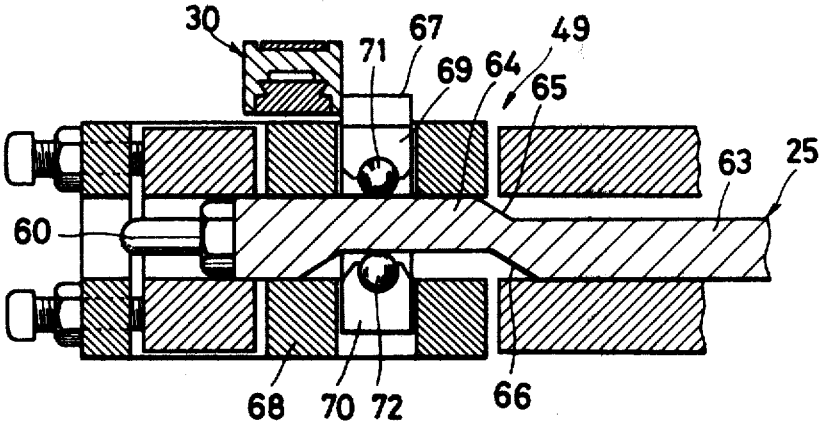
FIG. 4 is an enlarged horizontal cross-sectional view of an index-plate stop.

FIG. 4 illustrates an indexing plate stop 49 including a pair of horizontally offset portions 63,64 on the rack 25 which are interconnected by a pair of cam surfaces 65,66. A cam follower 67 is transversely slidably mounted in a fixed guide 68 and has a pair of spaced upright brackets 69,70 disposed one on each side of the rack 25. The brackets 69,70 support a pair balls 71,72, respectively, held in contact with opposite surfaces of the rack 25. As the rack 25 is advanced leftwardly in FIG. 4, the cam follower 67 is displaced by the cam surfaces 65,66 so as to be withdrawn into the fixed guide 68. Conversely, rightward returning movement of the rack 25 causes the cam surfaces 65,66 to shift the cam follower 67 laterally into a path of angular movement of the slider supports 30, whereupon a lowermost one (shown in FIG. 4) of the slider supports 30 is prevented by the cam follower 67 against further angular movement.

Advancing movement of the rack 25 to the left in FIG. 1 allows only the pinion 22 to rotate, with the indexing plate 21 being held non-rotatable. When the rack 25 is returned rightwardly, the indexing plate 21 is angularly moved counterclockwise through 90 degrees to bring the slider supports 30 to four angularly spaced positions; a first position in alignment with the guide groove 51, a succeeding second position with the slider locking means 14, a succeeding third position with the fingers 58,59 of the slider removing means 15, and a succeeding fourth position adjacent to the cam follower 67.

Figure 6A:
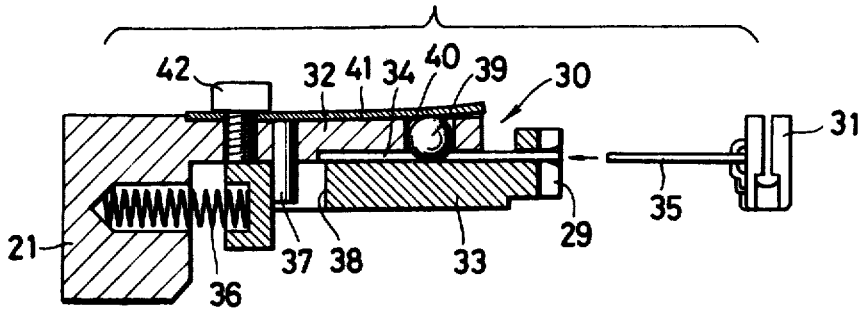
FIGS. 6A, 6B and 6C are enlarged cross-sectional views illustrative of progressive steps of holding a slider on the slider support.
Figure 6B:
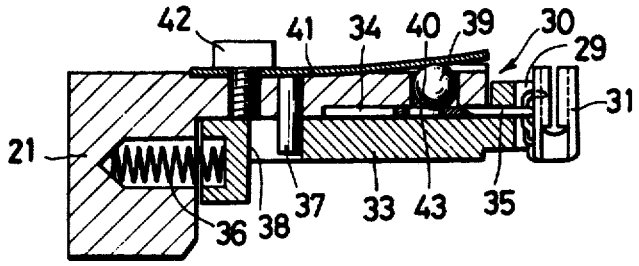
Figure 6C:
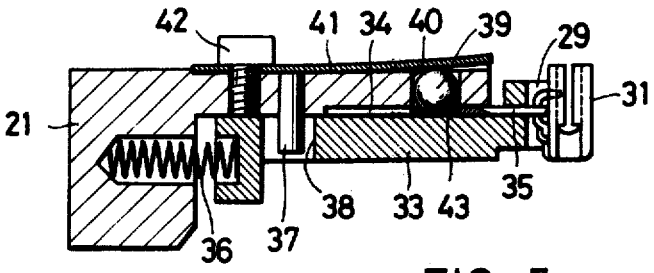

The apparatus thus constructed will operate as follows: When the operator steps on a foot switch (not shown) to energize the fluid-pressure actuator 26, the rack 25 advances leftwardly until the rod 60 pushes the lever 55 away from the frame 11 to discharge the slider 31 from the slider support 30 at the third position. As the rack 25 is retracted in the rightward direction, the indexing plate 21 is angularly moved counterclockwise to bring the slider supports 30 to their respective positions, during which time one slider 31 is advanced through the guide groove 51 by the pusher rod 52. While the indexing plate 21 is held at rest by the cam follower 67 and the rack 25 is being advanced again, the slider 31 is pushed by the pusher rod 52 until the pull tab 35 is inserted into the slot 34 and the slide 33 is forced radially inwardly by the slider 31 (FIGS. 6A and 6B) to get the hole 43 in the pull tab 35 slightly past the ball 39 against the force of the spring 36. Such movement of the slide 33 is stopped when one end of the slot 38 is engaged by the pin 37. Then, the pusher rod 52 is moved backwardly to allow the slide 33 to be slightly returned under the force of the spring 36 until the ball 39 partly enters into the hole 43 in the pull tab 35 under the force of the leaf spring 41 (FIG. 6C). At this time, the slider 31 is supported on the slider rest 29 since the pull tab 35 is retained in the slot 34 by the spring-biased ball 39 with a force large enough to hold the slider 31 during angular movement of the indexing plate 21.

The rack 25 is now moved backwardly to bring the slider support 30 carrying the slider thereon up to the second position in which the ball 39 is pressed harder into the hole 43 by the spring-biased presser 45 as shown in FIGS. 2 and 3, whereby the slider 31 is locked in position on the slider rest 29, a condition ready for application to a pair of slide fastener stringers 73,74 attached to a garment 75 such as a fly, which however may be sewn to the stringers 73,74 after assemblying of the slider 31. While the stringers 73,74 are being threaded through the slider 31, the rack 25 is moved forwardly, and after the threading of the stringers 73,74 the rack 25 is returned to cause the slider support 30 on which the slider 31 applied to the stringers 73,74 is retained, to be angularly moved down to the third position. By being pushed by the rod 60 on the rack 25 being driven forwardly, the fingers 58,59 of the lever 55 are displaced leftwardly in FIG. 7 to lift the slider 31 off the slider rest 29 with the ball 39 being squeezed out of the hole 43 in the pull tab 35 against the resiliency of the leaf spring 41.

After slider removal, the indexing plate 21 is again turned counterclockwise by backward movement of the rack 25. The lever 55 is pivotally moved toward the frame 11 under the force of the spring 57 in the abasence of engagement by the rod 60. The slider support 30 when in the fourth position supports no slider and is hence rendered idle.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. An apparatus for holding sliders for application to pairs of slide fastener stringers, comprising:

(a) a frame;

(b) an indexing plate having a plurality of angularly spaced supports each for carrying one slider and rotatably mounted on said frame, and means for intermittently indexing said plate to advance sliders carried on the respective support through at least three successive, angularly spaced positions, each of said slider supports having a slot receptive of the pull tab of the slider and a spring-biased ball normally urged toward said slot to partly enter therein;

(c) means for supplying sliders one at a time to said slider supports at a first position by inserting pull tabs of said sliders in said slots;

(d) a spring-biased presser mounted on said frame for normally urging into pressing engagement with said spring-biased ball of one of said slider supports at a succeeding second position for coaction therewith to lock the slider on said support, whereby a pair of slide fastener stringers can be threaded through the slider as locked; and (e) means for successively removing the sliders from said supports at a succeeding third position.

2. An apparatus according to claim 1, including a shaft rotatably mounted on said frame and supporting said indexing plate thereon, a pinion rotatably mounted on said shaft, a one-way clutch interposed between said shaft and said pinion whereby said indexing plate can be angularly moved in response to angular movement of said pinion only in one direction, and a rack supported on said frame in driving mesh with said pinion and reciprocably movable a fixed distance to angularly move said pinion angularly in both directions.

3. An apparatus according to claim 2, including a fluid-pressure actuator mounted on said frame and operatively connected to said rack for reciprocably moving the latter by said fixed distance.

4. An apparatus according to claim 2, said slider supplying means comprising a fluid-pressure actuator mounted on said frame and having a pusher rod for inserting the pull tab of a slider into said slider support until the pull tab is retained therein.

5. An apparatus according to claim 2, said slider removing means comprising a lever pivotably mounted on said frame and engageable with the slider carried by one of said slider supports at said third position, and a rod mounted on said rack and responsive to movement of said rack by said fixed distance for pushing the lever in a direction to withdraw the pull tab of the slider out of said slider support.

6. An apparatus according to claim 2, including means for stopping rotation of said indexing plate in response to completion of movement of said rack by said fixed distance.

7. An apparatus according to claim 6, said stopping means comprising a cam surface on said rack and a cam follower movably mounted on said frame and displaceable into interference with said indexing plate in response to being engaged by said cam surface.

8. An apparatus according to claim 2, in which said shaft is horizontal and said indexing plate is rotatably in a vertical plane.

9. An apparatus according to claim 8, in which said supports are in an uppermost position when in said second position.

10. An apparatus according to claim 2, further comprising brake means for frictionally holding said indexing plate in each of said three successive positions of said supports.

11. An apparatus for holding sliders for application to pairs of slide fastener stringers, comprising:

(a) a frame;

(b) means for intermittently advancing sliders carried thereon through at least three consecutive, angularly spaced positions, said advancing means comprising an indexing plate having a plurality of angularly spaced supports each for carrying one slider, a shaft rotatably mounted on said frame and supporting said indexing plate thereon, a pinion rotatably mounted on said shaft, a one-way clutch interposed between said shaft and said pinion whereby said indexing plate can be angularly moved in response to angular movement of said pinion only in one direction, and a rack supported on said frame in driving mesh with said pinion and reciprocably movable a fixed distance to move said pinion angularly in both directions;

(c) means for supplying sliders one at a time to said advancing means at a first position;

(d) means for coacting with said advancing means to lock the slider on said advancing means at a succeeding second position, whereby a pair of slide fastener stringers can be threaded through the slider as locked; and (e) means for removing the slider from said advancing means at a succeeding third position, said slider removing means comprising a lever pivotably mounted on said frame and engageable with the slider carried by one of said slider supports at said third position, and a rod mounted on said rack and responsive to movement of said rack by said fixed distance for pushing the lever in a direction to withdraw the pull tab of the slider out of said slider support.

12. An apparatus for holding sliders for application to pairs of slide fastener strings, comprising:

(a) a frame;

(b) means for intermittently advancing sliders carried thereon through at least three consecutive, angularly spaced positions, said advancing means comprising an indexing plate having a plurality of angularly spaced supports each for carrying one slider, a shaft rotatably mounted on said frame and supporting said indexing plate thereon, a pinion rotatably mounted on said shaft, a one-way clutch interposed between said shaft and said pinion whereby said indexing plate can be angularly moved in response to angular movement of said pinion only in one direction, and a rack supported on said frame in driving mesh with said pinion and reciprocably movable a fixed distance to move said pinion angularly in both directions;

(c) means for supplying sliders one at a time to said advancing means at a first position;

(d) means for coacting with said advancing means to lock the slider on said advancing means at a succeeding second position, whereby a pair of slide fastener stringers can be threaded through the slider as locked;

(e) means for removing the slider from said advancing means at a succeeding third position, and (f) means for stopping rotation of said indexing plate in response to completion of movement of said rack by said fixed distance, said stopping means comprising a cam surface of said rack and a cam follower movably mounted on said frame and displaceable into interference with said indexing plate in response to engagement by said cam surface.

* * * * *